US005394077A

United States Patent [19]

Atsumi

[11] Patent Number: 5,394,077

[45] Date of Patent: Feb. 28, 1995

[54] INTERNAL POWER SUPPLY CIRCUIT FOR USE IN A SEMICONDUCTOR DEVICE

[75] Inventor: Shigeru Atsumi, Tokyo, Japan

[73] Assignee: Kabushiki Kaisha Toshiba, Kawasaki, Japan

[21] Appl. No.: 214,105

[22] Filed: Mar. 17, 1994

[30] Foreign Application Priority Data

Apr. 30, 1993 [JP] Japan ..... 5-103415

[51] Int. Cl.[6] ..... G05F 1/613

[52] U.S. Cl. ..... 323/223

[58] Field of Search ..... 323/223, 224, 226, 282, 323/289; 364/273.1, 273.2; 365/189.09, 204, 226, 227; 307/46, 48, 66, 75

[56] References Cited

U.S. PATENT DOCUMENTS 4,961,220 10/1990 Tentler et al. ..... 323/223
5,233,566 8/1993 Imamiya et al. ..... 365/230.08
5,235,520 8/1993 Yokouchi ..... 323/223
5,253,201 10/1993 Atsumi et al. ..... 365/189.09

FOREIGN PATENT DOCUMENTS 0103522 6/1982 Japan ..... 323/223
0003726 1/1985 Japan ..... 323/223

*Primary Examiner*—R. Skudy
*Assistant Examiner*—Matthew Nguyen
*Attorney, Agent, or Firm*—Banner, Birch, McKie & Beckett

[57] ABSTRACT

A boosting circuit generates an internal high voltage of a level higher than that of an internal voltage which is used in a semiconductor memory device. The boosting circuit has an output end connected to a capacitor having a large capacitance, and this capacitor is charged to an internal high voltage. The output end of the boosting circuit is connected to a drain of an N-channel transistor. This transistor has a gate which is supplied with a voltage $V_G$ higher than the internal voltage by a difference equivalent to a threshold voltage of the transistor. The internal voltage is outputted from a source of the transistor. When a skew occurs and the internal voltage is lowered while an address signal is changed, the internal high voltage charged in the capacitor is discharged through the transistor and the internal voltage is thus stabilized.

14 Claims, 5 Drawing Sheets

INTERNAL POWER SUPPLY CIRCUIT FOR USE IN A SEMICONDUCTOR DEVICE

BACKGROUND OF THE INVENTION

1. Field of the Invention

The present invention relates to an internal power supply circuit for use in a semiconductor device, which generates a voltage higher than can be supplied from an external device, to read data from a flash memory, which is capable of flash-erasing stored data, a DRAM (Dynamic Read Only Memory), a SRAM (Static Random Access Memory) or the like.

2. Description of the Related Art

A non-volatile semiconductor memory, such as a flash memory, comprises an EEPROM (Electrically Erasable Programmable Read Only Memory) capable of electrically writing or erasing data. A non-volatile semiconductor memory uses a transistor of a stacked gate type as a memory cell. The transistor has a floating gate FG and a control gate CG, as shown in FIG. 14. Data is written into or read from the memory cell, in such a manner that a threshold voltage is changed by injecting electrons into the floating gate FG or releasing electrons. In a conventional flash memory, a source voltage Vcc is applied to the control gate CG of a selected memory cell when reading data, and the logic concerning "1" or "0" is determined depending on whether or not a current flows in this condition. The threshold voltage of a memory cell, is approximately 2 V when the memory cell is on and is approximately 5 V or more when the memory cell is off.

Conventionally, a power source voltage is set at 5 V, and a gate voltage $V_G$ is set at 5 V when data is read. Further, a conventional flash memory has an arrangement in which a power source voltage of 5 V is directly applied as a voltage for reading data to the control gate CG, and this arrangement does not cause problems. However, as the size of a memory cell becomes smaller and the capacitance thereof is enlarged, the power source voltage of a memory cell must be lowered. Nowadays, a power source voltage of 3 V is substantially standardized in general cases.

If a conventional power source voltage of 5 V is used, the difference between a voltage $V_G$ applied to the control gate CG to read data and a threshold voltage $V_{TH}$ when the memory cell is on is 3 V: $V_G-V_{TH}=5-2=3$ V. On the other hand, if a power source voltage of 3 V is used, the difference is 1 V: $V_G-V_{TH}=3-2=1$ V. The latter difference is as small as one third of the former, and a current flowing through a memory cell is therefore reduced. Due to a decrease in the cell-current, the reading speed is lowered and a margin for the power source voltage is reduced.

In order to solve the problems stated above, a method is used in which an external voltage Vccext of 3 V supplied from outside of a chip is boosted in the chip, for example, to generate an internal voltage Vccint of 5 V, and this internal voltage Vccint is applied to the control gate of the memory cell.

FIG. 15 shows a conventional boosting circuit. A boosting circuit is a kind of positive charge pump circuit comprising an oscillator OSC, an inverter circuit IV, a plurality of diodes D, and a plurality of capacitors Cp. In the boosting circuit, an output voltage of the oscillator OSC and a voltage inverted by the inverter circuit IV are alternately supplied to a plurality of capacitors Cp and diodes D, and a predetermined boost voltage is thus generated. The boost voltage outputted from this boosting circuit is applied to a control gate of a memory cell.

FIG. 16 is a schematic view showing a semiconductor memory device, i.e., an example of an arrangement which covers from an address signal input to a word line selection for the memory cell array. A power source voltage Vccext is supplied to an address buffer (referred to as ADB, hereinafter) 21 receiving an address signal ADD. An output signal of the ADB is, for example, supplied to a row address decoder (referred to as RDC, hereinafter) 22 including a pre-decoder. An external voltage Vccext as a power source and an internal voltage Vccint generated by a boosting circuit shown in FIG. 15 are supplied to the RDC 22, and the output signal of the ADB 21 stated above is decoded in the RDC 22. A signal thus decoded of a signal level for the external voltage Vccext system is converted into a signal of a level for an internal voltage Vccint system, and is then supplied to a word line of a memory cell array (referred to as MCA, hereinafter) 23 not shown in figures. This MCA 23 comprises, for example, a plurality of EEPROMs disposed like a matrix. A line address decoder is omitted herefrom.

Meanwhile, a semiconductor device generally has a so-called skew, i.e., a period in which an address signal ADD is not kept constant while the address signal ADD is being changed. While a skew appears, a selection state of the address decoder is not kept stable, and therefore, a large current flows through the address recorder. Consequently, a peak current cannot be maintained at a constant value while an address signal is being changed. A peak current flowing while an address signal is being changed is not so large and therefore does not cause problems. This is because, a DRAM changes address signals in synchronization with clock signals supplied from outside, so that only a small skew occurs and a current flowing in the device can be controlled within a predetermined range of values. However, in case of a static memory, such as a flash memory or a SRAM, which changes address signals without synchronization with clock signals supplied from outside, a skew occurs while an address is being changed, and the skew causes rapid changes in the selection state of the address decoder, so that a large current flows through the address decoder. This is a factor which significantly reduces an internal voltage Vccint.

In the boosting circuit stated above, a current supply ability is limited due to sizes of pattern areas and consumption currents. Once a large current flows as a skew occurs, a long time is required to recover an internal voltage Vccint. More specifically, a peak current generated during a skew is as large as 100 mA, while the current supply ability of a boosting circuit is only about 10 mA. As a result of this, correct data reading cannot be carried out when a reading operation is carried out before the internal voltage Vccint recovers.

SUMMARY OF THE INVENTION

The object of the present invention is to provide an internal power supply circuit for use in a semiconductor device, which can supply a stable internal voltage even when a large current temporarily flows, for example, even when an address is changed.

The object of the invention is achieved by the following arrangement.

An internal power supply circuit included in a semiconductor device, comprising:

boosting means for boosting an external voltage to a second internal voltage of a higher level than that of a first internal voltage used in the semiconductor device, the first internal voltage being higher than the external voltage;

retaining means connected to an output end of the boosting means, for retaining the second internal voltage outputted from the boosting means; and generating means connected to an output end of the boosting means, for generating the first internal voltage from the second internal voltage, the first internal voltage being supplied therefrom to the semiconductor device, and the second internal voltage retained in the retaining means being discharged by the generating means when the first internal voltage is decreased while an address signal of the semiconductor device is being changed.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

Embodiments of the present invention will be explained below, with reference to the drawings.

Figure 1:
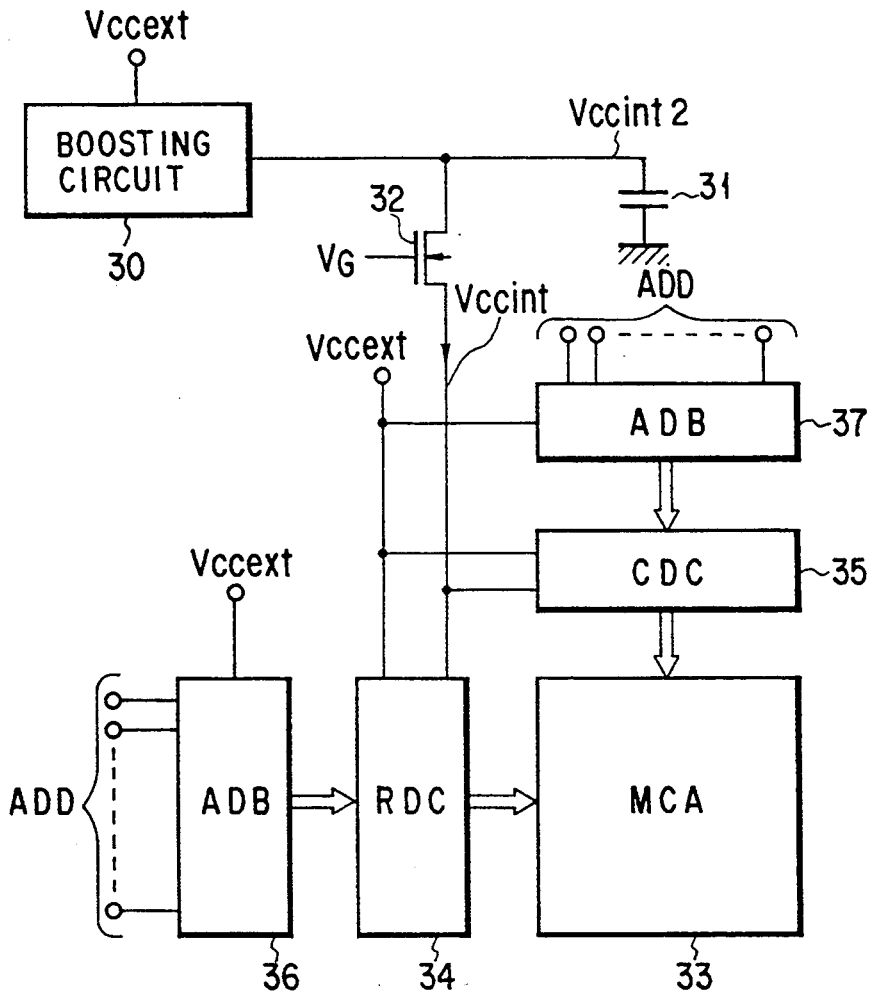
FIG. 1 is a circuit diagram showing a first embodiment of the present invention.

FIG. 1 shows a first embodiment of the present invention. In FIG. 1, a boosting circuit 30 has the same arrangement as the circuit shown in FIG. 15. The boosting circuit of FIG. 1, however, outputs a higher voltage than the boosting circuit of FIG. 15. An output end of the boosting circuit 30 is connected with a capacitor 31 having a large capacitance of, for example, 1 nF. The boosting circuit 30 charges the capacitor 31 to a level of an internal high voltage Vccint2 higher than an internal voltage Vccint. A drain of an N-channel transistor 32 is also connected to a node connecting the output end of the boosting circuit 30 with the capacitor 31. A gate of the transistor 32 is supplied with a voltage $V_G$, and an internal voltage Vccint is outputted from a source of the transistor 32. The voltage $V_G$ stated above is set to be higher than the internal Vccint by a voltage difference equivalent to a threshold voltage of the transistor 32. Therefore, the transistor 32 is turned off when the source potential is increased to the internal voltage Vccint.

Meanwhile, an MCA 33 comprising, for example, an EEPROM is connected with an RDC 34 including, for example, a pre-decoder and with a column address decoder (referred to as CDC, hereinafter) 35. The RDC 34 and CDC 35 are supplied with an external voltage Vccext and an internal voltage Vccint outputted from the source of transistor 32 stated above. The RDC 34 and CDC 35 are respectively connected with ADBs 36 and 37 which retain address signals ADD. These ADBs 36 and 37 are supplied with an external voltage Vccext.

Figure 2:
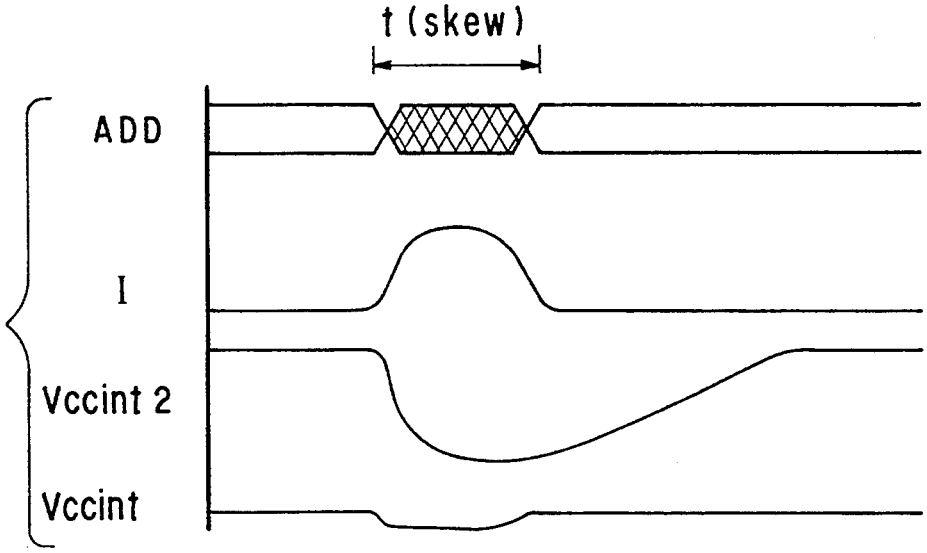
FIG. 2 is a graph showing waveforms explaining operations of the embodiment in FIG. 1.

FIG. 2 shows operations of the circuit shown in FIG. 1. When a skew occurs, for example, in the RDC 34 while changing an address signal ADD, a large current I (Vccint) which exceeds the current supply ability of the boosting circuit 30 flows through the RDC 34 and the internal voltage Vccint is lowered. In this case, however, an internal high voltage Vccint2 charged in the capacitor 31 is discharged through the transistor 32. The internal voltage Vccint supplied to the RDC can thus be maintained to be substantially constant. After the skew ends, the internal voltage Vccint is rapidly recovered to a predetermined potential, and therefore, data can be correctly and exactly read out from a memory cell in accordance with a fixed address signal ADD.

A current required for a conventional boosting circuit is obtained by dividing a current during an address skew by a skew time t(skew), and is represented as follows:

$$\frac{\int I(Vccint)dt}{t(\text{skew})} \quad (1)$$

However, in this embodiment, a current required for a boosting circuit is obtained by dividing a current during an address skew by a switching cycle t(cycle) of an address signal, and is represented as follows:

$$\frac{\int I(Vccint)dt}{t(\text{cycle})} \quad (2)$$

A skew time t(skew) is about 10 ns, while the switching cycle t(cycle) of an address signal is 100 ns. Therefore, as is apparent from the formulas (1) and (2), the boosting circuit of this embodiment requires only a current supply ability of 1/10 of that required for a conventional boosting circuit.

According to the above embodiment, an internal high voltage Vccint2 higher than an internal voltage Vccint is changed in a capacitor 31 and is used as a virtual power source. Therefore, when a skew occurs while changed an address signal to make a large current flow through an address decoder, the internal high voltage Vccint2 thus charged in the capacitor 31 is discharged and decreases in the internal voltage Vccint can be thereby restricted. In addition, since the boosting circuit does not require a current supply ability as high as that required for a peak current of the internal voltage Vccint, the pattern area of the boosting circuit can be reduced to be small.

Figure 3:
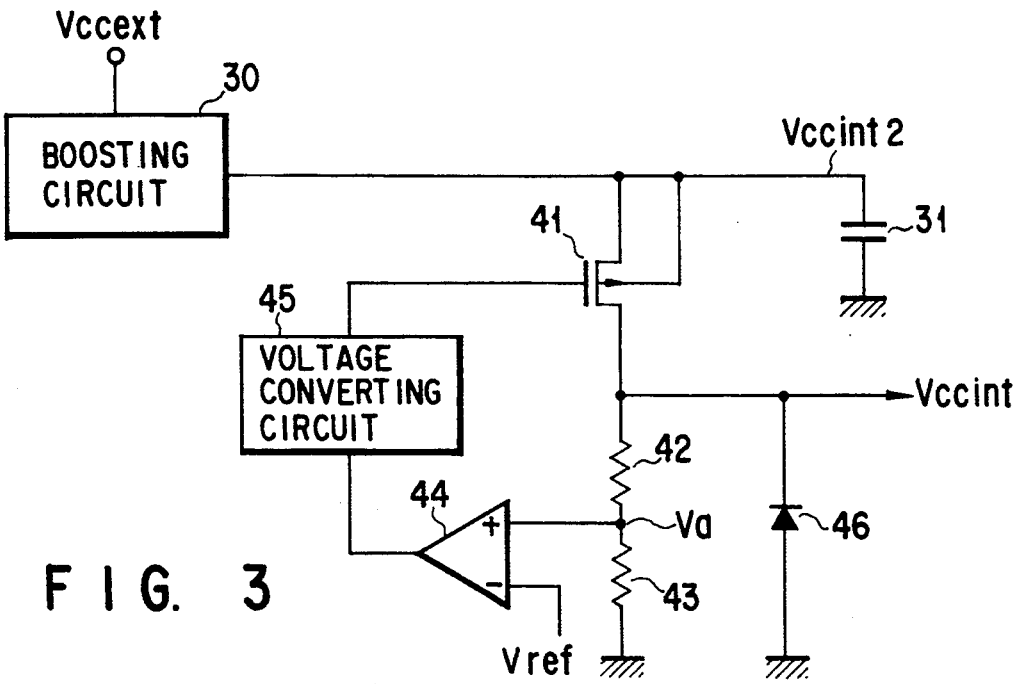
FIG. 3 is a circuit diagram showing a second embodiment of the present invention.

FIG. 3 shows a second embodiment of the present invention. In FIG. 3, the same components as those of FIG. 1 are denoted by the same reference numerals or symbols. In FIG. 3, an output end of a boosting circuit 30 is connected with a source of a P-channel transistor 41. Resistors 42 and 43 are connected between a drain of the transistor 41 and a ground, and an internal voltage Vccint is outputted from the drain of the transistor 41.

A connection node connecting the resistors 42 and 43 is further connected to a non-inverting input end of a comparator 44, and a voltage Va obtained by dividing the internal voltage Vccint is supplied to the non-inverting input end. An inverting input end of the comparator 44 is supplied with a reference voltage Vref, and an output end of the comparator 44 is connected to a gate of the transistor 41 through a voltage converting circuit 45. The comparator 44 is operated by an external voltage Vccext, and an output voltage of the comparator 44 which complies with a system using an external voltage Vccext is converted into a voltage which complies with a system using an internal high voltage Vccint2, by the voltage converting circuit 45. In addition, the circuit shown in FIG. 3 is a kind of feed-back circuit. Therefore, in order to prevent overshoot, a diode 46 is connected in a reversal direction between the drain of the transistor 41 and the ground, for example.

Figure 4:
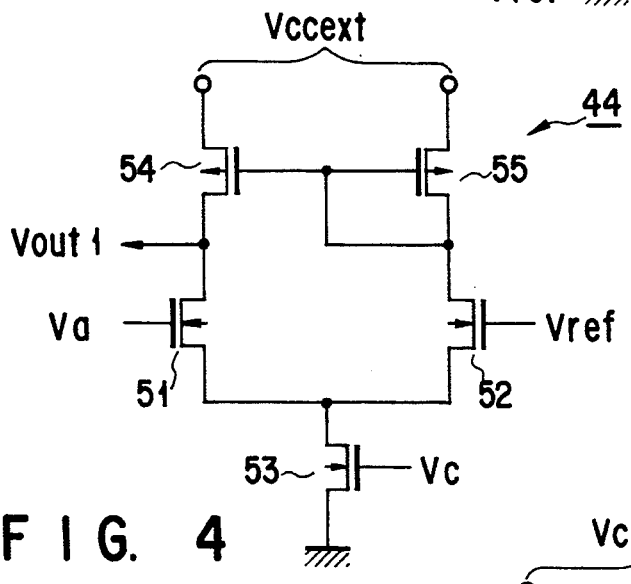
FIG. 4 is a circuit diagram showing an example of a comparator shown in FIG. 3.

FIG. 4 shows an example of a comparator 44. A voltage Va generated by resistors 42 and 43 is supplied to a gate of an N-channel transistor 51, while a reference voltage Vref is supplied to a gate of N-channel transistor 52. The sources of the transistors 51 and 52 are grounded through an N-channel transistor 53 which serves as a constant current source. A constant voltage Vc is supplied to a gate of the transistor 53. A drain of the transistor 51 is connected to a drain of a P-channel transistor 54, while a drain of the transistor 52 is connected to a drain of P-channel transistor 55. These transistors 54 and 55 have gates commonly connected to the drain of the transistor 52, and the sources of the transistors 54 and 55 are connected to an external power source Vccext. An output voltage Vout1 is outputted from the drain of the transistor 51.

Figure 5:
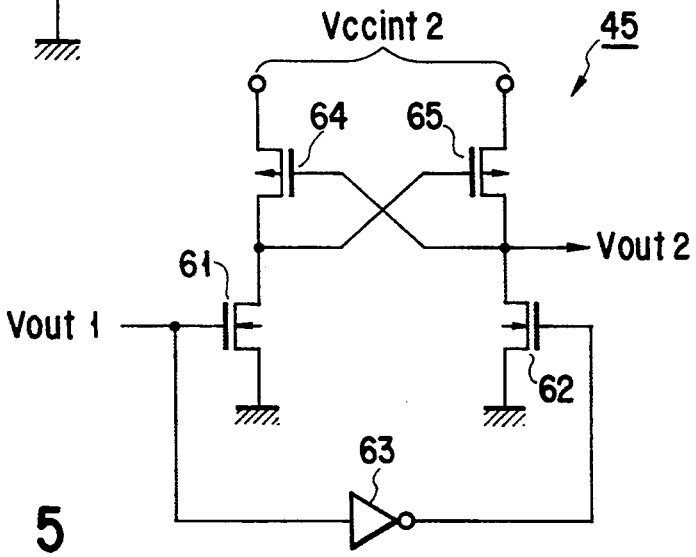
FIG. 5 is a circuit diagram showing an example of a voltage converting circuit shown in FIG. 3.

FIG. 5 shows an example of a voltage converting circuit 45. An output voltage Vout1 is supplied to an gate of an N-channel transistor 61, and the output voltage Vout1 is also supplied to a gate of an N-channel transistor 62 through an inverter circuit 63. Sources of these transistors 61 and 62 are grounded, and drains thereof are respectively connected to drains of P-channel transistors 64 and 65. The transistor 65 has a gate connected to the drain of the transistor 61, and the transistor 64 has a gate connected to the drain of the transistor 62. Sources of these transistors 64 and 45 are each connected to the external voltage Vccext. An output voltage Vout2 is outputted from the drain of the transistor 62.

In the arrangement stated above, a voltage Va which is obtained by dividing an internal voltage Vccint by means of resistors 42 and 43 is compared with a reference voltage Vref by the comparator 44. The comparator 44 outputs a voltage of a low level when the compared voltages stated above satisfy a relation: Va<Vref. A voltage of a high level is outputted from the comparator 44 when the compared voltages satisfy a relation: Va>Vref. The output voltage of the comparator 44 is converted into a voltage which complies with a system for an internal high voltage Vccint2, by the voltage converting circuit 45, and is then supplied to a gate of the transistor 41. When the internal voltage Vccint decreases in accordance with an occurrence of a skew of an address signal, the transistor 41 is rendered conductive and charges of the capacitor 31 are discharged through the transistor 41. Decreases in the internal voltage Vccint can thus be reduced. In addition, overshoot can be prevented by the diode 46 such that the break-down voltage thereof in the reversal direction is equal to the internal voltage Vccint.

Figure 6:
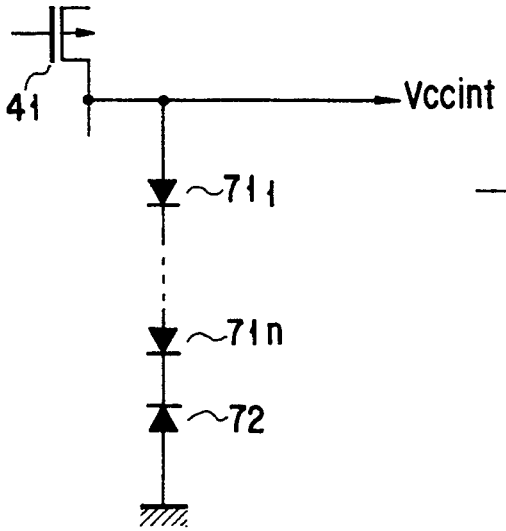
FIG. 6 is a circuit diagram showing a variation of a diode shown in FIG. 3.

In the embodiment shown in FIG. 3, overshoot is prevented by use of a single diode. However, other variations may be adopted in place of using a single diode. In FIG. 6, a plurality of diodes $71_1$ to $71_n$ arranged in a forward direction and a diode 72 arranged in a reversal direction are connected in series, and these diodes $71_1$ to $71_n$ and 72 are connected between a drain of the transistor 41 and the ground. This arrangement can prevent overshoot.

Figure 7:
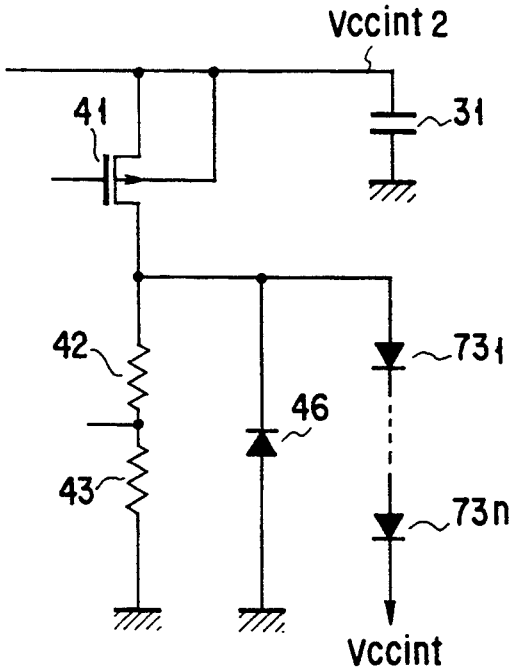
FIG. 7 is a circuit diagram showing a variation of a diode shown in FIG. 3.

In FIG. 7, a diode 46 is connected in a reversal direction between the drain of the transistor 41 and the ground, and a plurality of diodes $73_1$ to $73_n$ are connected in a forward direction in series with a cathode of the diode 46. In this case, an internal voltage Vccint outputted from a cathode of the diode $73_n$ is expressed as $Vz-n.V_F$, where Vz is a break-down voltage of the diode 46 arranged in a reversal direction, $n.V_F$ is voltage of an n pieces of diodes $73_1$ to $73_n$ arranged in a forward direction. A break-down voltage of a diode in a reversal direction has a specific temperature characteristic. When the break-down voltage Vz in the reversal direction satisfies a relation: Vz<5 V, the diode dominantly causes a Zener break-down. When the bread-down voltage Vz in the reversal direction satisfies a relation: Vz>5 V, the diode dominantly causes an avalanche break-down. When Vz is 5 V, the both kinds of break-down effects cancels each other, so that the temperature characteristic substantially disappears. Therefore, taking into consideration diodes, the arrangement shown in FIG. 3 is ideal. The arrangement shown in FIG. 7 is preferred, for example, when an internal voltage of 4.5 V is required.

Figure 8:
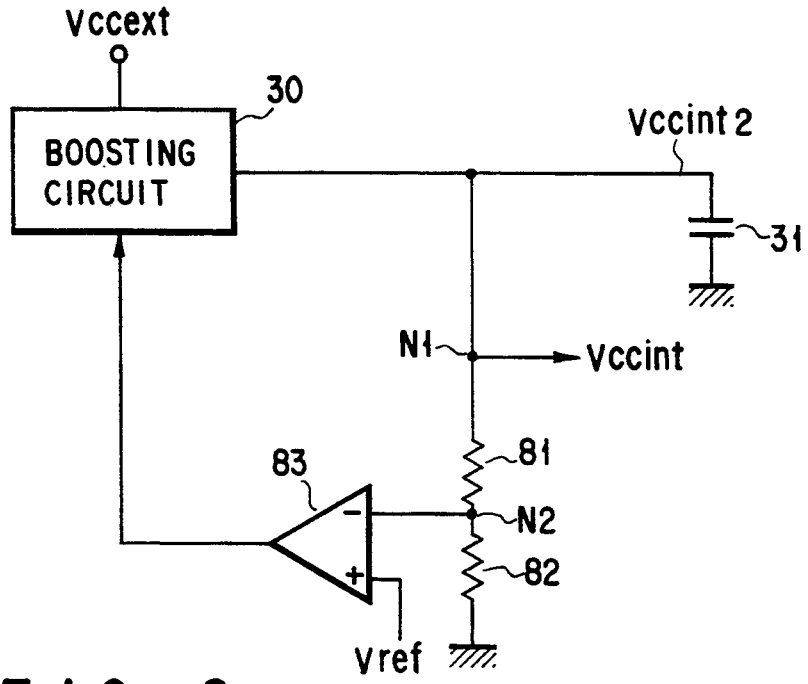
FIG. 8 is a circuit diagram showing a third embodiment of the present invention.

FIG. 8 shows a third embodiment of the present invention. In this embodiment, a boosting circuit 30 needs not be continuously operated as in the embodiment shown in FIG. 3. It is sufficient for this embodiment that a relationship between an internal high voltage Vccint2 and an internal voltage Vccint satisfies at least a relation: Vccint2>Vccint, for example, when a skew occurs with respect to an address signal and a large current flows through an address decoder, to cause a voltage drop. Therefore, in the third embodiment, the boosting circuit 30 is not continuously operated, but is operated when necessary.

More specifically, in FIG. 8, resistors 81 and 82 are connected in series between a ground and a connection node connecting an output end of the boosting circuit 30 with the capacitor 31. An internal voltage Vccint is outputted from a connection node N1. A connection node N2 between the resistors 81 and 82 is connected to an inverting input end of a comparator 83, while a reference voltage Vref is supplied to a non-inverting input end of the comparator 83. An output end of the comparator 83 is connected to the boosting circuit 30. The comparator 83 compares a reference voltage Vref and a partial voltage obtained by dividing the internal voltage Vccint by the resistors 81 and 82, and drives the boosting circuit 30 when the partial voltage is lower than the reference voltage and stops the boosting circuit 30 when the partial voltage is higher than the reference voltage. Therefore, the power consumption can be reduced in comparison with a case in which the boosting circuit is continuously operated.

The circuit shown in FIG. 8 is a kind of feed-back circuit. Therefore, overshoot can be prevented by connecting the diode 46 between the connection node N1 and the ground, as shown in FIG. 3.

Figure 9:
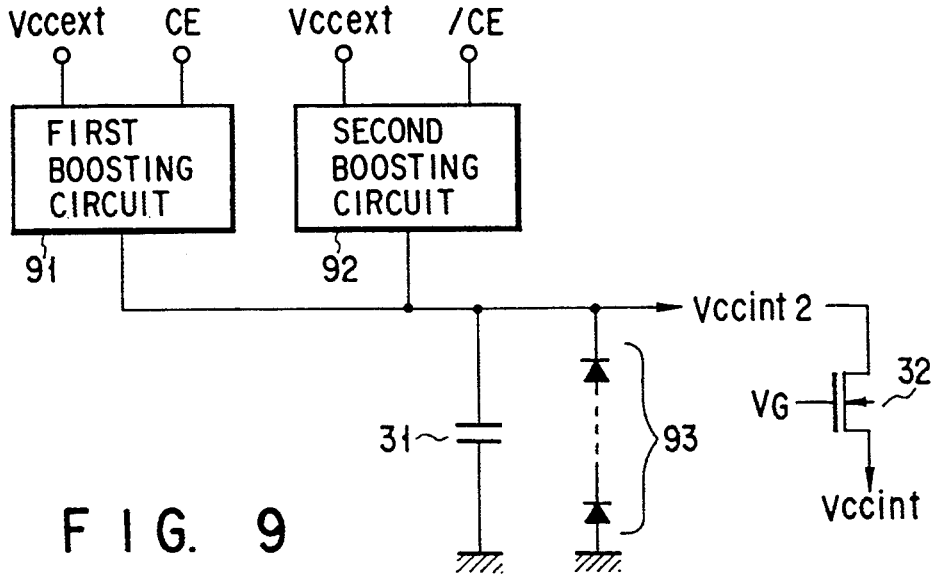
FIG. 9 is a circuit diagram showing a fourth embodiment of the present invention.

FIG. 9 shows a fourth embodiment of the present invention. As has been stated above, the boosting circuit shown in FIG. 3 is continuously operated. It is however desirable that a current consumption during a stand-by state be small in case of using the boosting circuit of FIG. 3. The fourth embodiment is designed to reduce a current consumption during a stand-by state.

Figure 15:
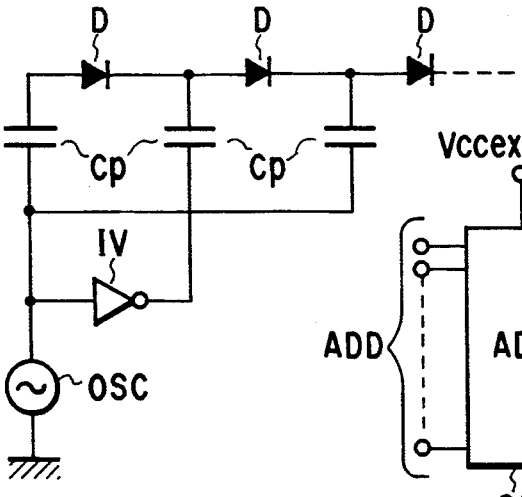
FIG. 15 (PRIOR ART)
FIG. 15 is a circuit diagram showing an example of a boosting circuit.
Figure 16:
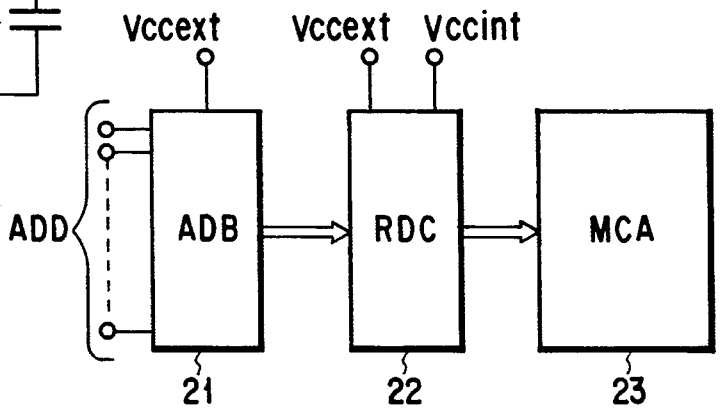
FIG. 16 (PRIOR ART)
FIG. 16 is a view schematically showing an arrangement of a semiconductor memory device.

In FIG. 9, a first boosting circuit 91 is arranged to have a high current supply ability, and a second boosting circuit 92 is arranged to have a current supply ability lower than that of the first boosting circuit 91. In each of the first and second boosting circuits 91 and 92, an external voltage Vccext is boosted to an internal high voltage Vccint2. Each of these boosting circuits 91 and 92 has an arrangement as shown in FIG. 15 except that the first boosting circuit 91 includes more capacitors Cp and diodes D than the second boosting circuit 92. The first boosting circuit 91 is operated and stopped, i.e., controlled in accordance with a chip enable signal CE, while the second boosting circuit 92 is operated and stopped, i.e., controlled in accordance with an inverted chip enable signal /CE. A capacitor 31 and a plurality of diodes 93 connected in series with each other are connected between output ends of the first and second boosting circuits 91 and 92 and the ground. The diodes 93 are provided in order to prevent overshoot of an internal high voltage Vccint2. Internal high voltages Vccint2 outputted from the first and second boosting circuits 91 and 92 are decreased to an internal voltage Vccint, for example, by a transistor 32 as shown in FIG. 1, a transistor 41, resistors 42 and 43, a comparison circuit 44, or a voltage converting circuit 45 as shown in FIG. 3.

In the arrangement as stated above, only the second boosting circuit 92 having a small current supply ability is operated in accordance with a chip enable signal /CE, during a stand-by state. A current consumption can thus by reduced during the stand-by state. On the other hand, the first boosting circuit 91 is operated when a chip enable signal CE is active. Therefore, decreases in the internal voltage Vccint can be prevented even when a skew occurs with respect to an address signal.

Figure 10:
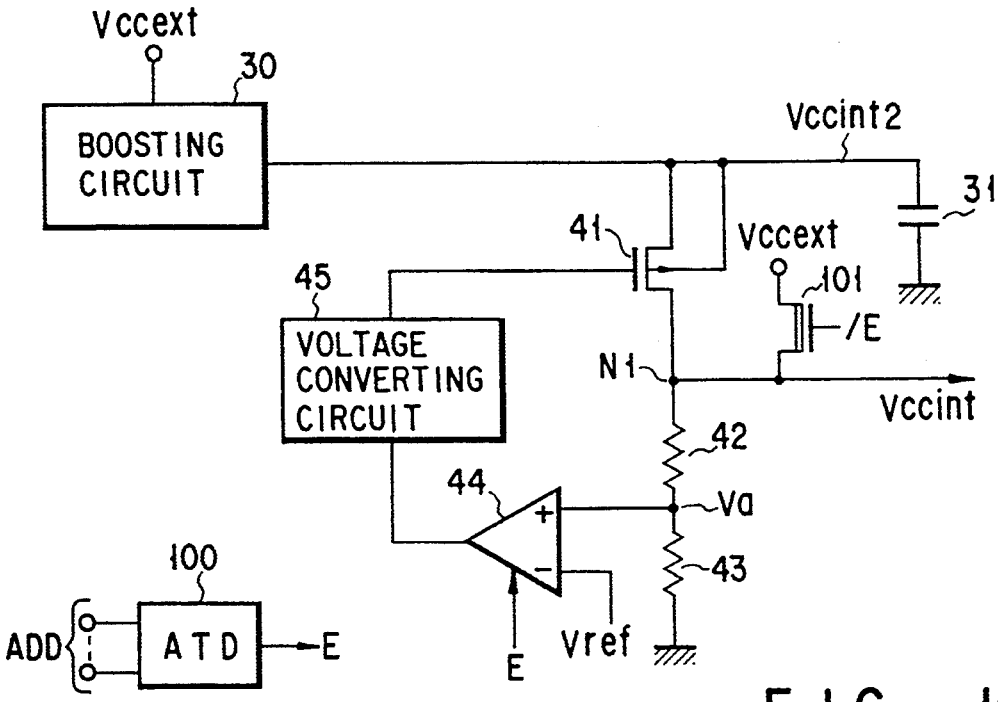
FIG. 10 is a circuit diagram showing a fifth embodiment of the present invention.

FIG. 10 shows a fifth embodiment of the present invention. In FIG. 10, the same components as those of FIG. 3 are denoted by the same reference numerals or symbols. In the fifth embodiment, operations of the comparator 44 and the like are controlled in accordance with an output signal of an address transition detector (referred to as ATD in the following) circuit 100 which detects a transition of an address signal ADD. Specifically, an output signal E of an ATD 100 is supplied to the comparator 44. A source of an N-channel transistor 101 of a depletion type is connected to a connection node N1 which connects a drain of a transistor 41 with a resistor 42. An inverted output signal/E of the ATD 100 is supplied to a gate of the transistor 101, while a source of the transistor 101 is connected to an external voltage Vccext.

Figure 11:
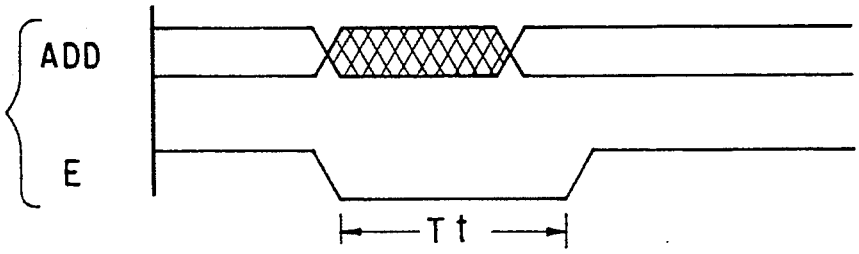
FIG. 11 is a timing chart for explaining an operation of the embodiment in FIG. 10.

FIG. 11 shows output signals of the ATD 100. An output signal E of the ATD 100 is set to a low level during a transition period Tt of an address signal ADD. The comparator 44 thereby stops operating, the transistor 101 is rendered conductive, and current supply from the capacitor 31 to the internal voltage Vccint is stopped. Meanwhile, when the transition period Tt of an address signal ADD ends, the output signal E of the ATD 100 is set to a high level, the comparator 44 is operated, and the transistor 41 is rendered conductive, so that a current is supplied from the capacitor 31 to the internal voltage Vccint.

In this embodiment, an unnecessary current can be reduced while a skew occurs with respect to an address signal. As a result, an amount of current required for a boosting circuit can be much reduced.

Figure 12:
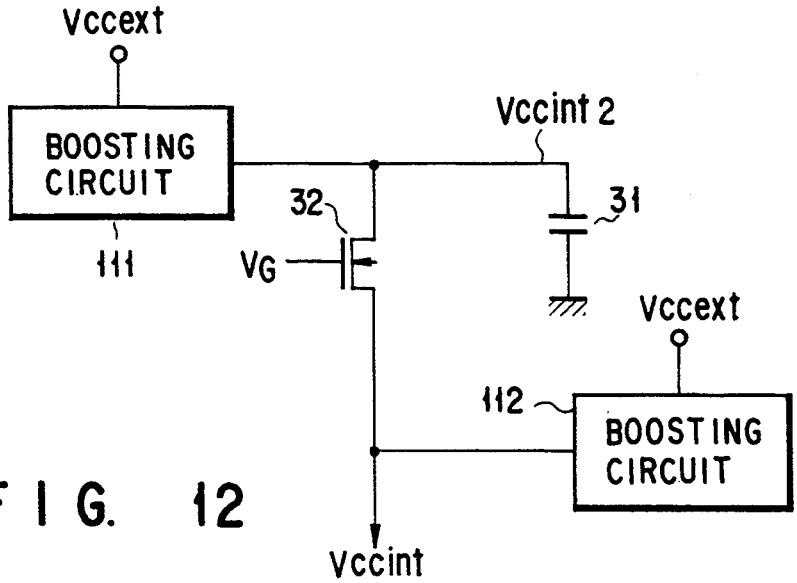
FIG. 12 is a circuit diagram showing a sixth embodiment of the present invention.

FIG. 12 shows a sixth embodiment of the present invention. In FIG. 12, the same components as those of FIG. 3 are denoted by the same reference numerals or symbols. In the sixth embodiment, a first boosting circuit 111 boosts, for example, an external voltage Vccext of 3 V to an internal high voltage Vccint2 of 8 V, while a second boosting circuit 112 boosts, for example, an external voltage Vccext of 3 V to an internal voltage Vccint of 5 V. Each of these first and second boosting circuits 111 and 112 has an arrangement as shown in FIG. 15, except that the firs boosting circuit 111 includes more capacitors Cp and diodes D than the second boosting circuit 112. In addition, the second boosting circuit 112 is arranged so as to have a current drive ability higher than that of the first boosting circuit 111. The first boosting circuit 111 has an output end which is connected to the capacitor 31 and which is also connected to a drain of a transistor 32. The transistor 32 has a gate supplied with a gate voltage $V_G$ and a source connected to an output end of the second boosting circuit 112.

In the above arrangement, an internal voltage Vccint is outputted from the second boosting circuit 112 during a normal operation, and the internal voltage Vccint is supplied to RDC, CDC, and the likes not shown in the figure. In this state, since the transistor 32 has a source potential equal to the internal voltage Vccint, the transistor 32 is therefore turned off and the capacitor 31 is charged to the level of the internal high voltage Vccint2 by the first boosting circuit 111.

When a skew occurs while changing an address signal and the internal voltage Vccint is decreased to be equal to or lower than a threshold voltage Vth of the transistor 32, the transistor 32 is turned on and the internal high voltage Vccint 2 charged in the capacitor 31 is discharged through the transistor 32. Therefore, the internal voltage Vccint rapidly recovers to an aimed value.

Figure 13:
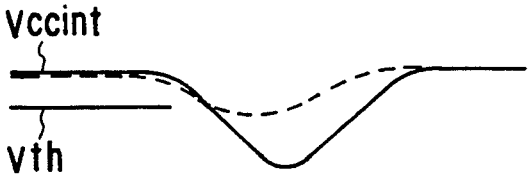
FIG. 13 is a graph showing waveforms explaining operations of the embodiment in FIG. 12.
Figure 14:
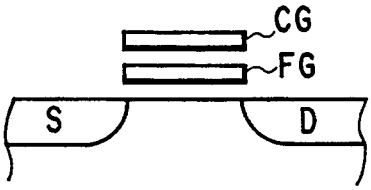
FIG. 14 (PRIOR ART)
FIG. 14 is a cross section schematically showing a structure of a cell transistor adopted in a flash memory.

In FIG. 13, a broken line indicates an operation of the embodiment shown in FIG. 12, and a continuous line indicates another operation of the embodiment shown in FIG. 12 in which the second boosting circuit 112 is omitted. As indicated by the continuous line in FIG. 13, a long time period is required until the internal voltage Vccint recovers an aimed value after the internal voltage Vccint is decreased, in case where the second boosting circuit 112 is omitted. This leads to energy loss. However, according to this embodiment, an internal voltage Vccint one decreased can rapidly recover to an aimed value. This embodiment is thus reduces energy loss.

What is claimed is:

1. An internal power supply circuit for use in a semiconductor device, comprising:

boosting means for boosting an external voltage to a second internal voltage of a higher level than that of a first internal voltage used in the semiconductor device, said first internal voltage being higher than the external voltage;

retaining means connected to an output end of the boosting means, for retaining the second internal voltage outputted from the boosting means; and generating means connected to the output end of the boosting means, for generating the first internal voltage from the second internal voltage, said first internal voltage being supplied therefrom to the semiconductor device, and said second internal voltage retained in the retaining means being discharged by the generating means when the first internal voltage is decreased while an address signal of the semiconductor device is being changed.

2. An internal power supply circuit according to claim 1, wherein said generating means includes an N-channel transistor having a current path, an end of which is connected to a node connecting the output end of the boosting means with the retaining means and from another end of which the first internal voltage is outputted, and a gate supplied with a voltage higher than the first internal voltage by a difference equivalent to a threshold voltage of the N-channel transistor.

3. An internal power supply circuit according to claim 1, wherein the retaining means includes a capacitor having a large capacitance of approximately 1 nF.

4. An internal power supply circuit for use in a semiconductor device, comprising:

boosting means for boosting an external voltage to a second internal voltage of a higher level than that of a first internal voltage used in the semiconductor device, said first internal voltage being higher than the external voltage;

retaining means for retaining the second internal voltage boosted by the boosting means;

a transistor having a current path, a first end of which is connected to an output end of the boosting means and to the retaining means, and from a second end of which the first internal voltage is outputted;

generating means connected to the second end of the current path of the transistor, for generating a comparison voltage to be compared, from the first internal voltage; and controlling means for controlling the transistor in accordance with a difference between the comparison voltage generated by the generating means and a reference voltage, thereby to render the transistor conductive and to discharge the second voltage retained in the retaining means through the transistor, when the comparison voltage is lower than the reference voltage.

5. An internal power supply circuit according to claim 4, wherein said control means comprising:

comparing means for comparing the comparison voltage generated by the generating means with the reference voltage; and converting means for converting an output signal of the comparing means into an output signal of a level equivalent to the external voltage, said output signal of the converting means being supplied to a gate of the transistor.

6. An internal power supply circuit according to claim 4, further comprising a diode connected to the second end of the current path of the transistor, for removing an oscillation component included in the first internal voltage.

7. An internal power supply circuit according to claim 4, further comprising:

a first diode connected to the second end of the current path of the transistor, for generating a third internal voltage lower than the second internal voltage, by using a break-down voltage; and a second diode for generating the first internal voltage from the third internal voltage, by using a forward voltage.

8. An internal power supply circuit for use in a semiconductor device, comprising:

boosting means for boosting an external voltage to a second internal voltage of a higher level than that of a first internal voltage used in the semiconductor device, said first internal voltage being higher than the external voltage;

retaining means for retaining the second internal voltage boosted by the boosting means;

generating means for generating the first internal voltage from the second internal voltage boosted by the boosting means, and for generating a comparison voltage to be compared, from the first internal voltage; and comparing means for comparing the comparison voltage outputted from the generating means with a reference voltage, and for stopping operation of the boosting means when the comparison voltage is higher than the reference voltage.

9. An internal power supply circuit for use in a semiconductor device, comprising:

first boosting means for boosting an external voltage to a second internal voltage higher than a first internal voltage used in the semiconductor device, said first boosting means being operated in accordance with an activating signal which activate the semiconductor device, and said first internal voltage being higher than the external voltage;

second boosting means for boosting the external voltage to the second internal voltage, said second boosting means having a current supply ability lower than a current supply ability of the first boosting means, and said second boosting means being operated in accordance with an inverted activating signal obtained by inverting the activating signal;

retaining means for retaining the second internal voltage generated by the first boosting means and the second boosting means; and generating means for generating the first internal voltage from the second internal voltage generated by the first boosting means and the second boosting means, said first internal voltage generated by the generating means being supplied to the semiconductor device.

10. An internal power supply circuit for use in a semiconductor device, comprising:

boosting means for boosting an external voltage to a second internal voltage of a higher level than that of a first internal voltage used in the semiconductor device, said first internal voltage being higher than the external voltage;

retaining means for retaining the second internal voltage boosted by the boosting means;

a transistor having a current path, a first end of which is connected to an output end of the boosting means and to the retaining means, and from a second end of which the first internal voltage is outputted;

generating means connected to the second end of the current path of the transistor, for generating a comparison voltage to be compared, from the first internal voltage;

detecting means for detecting a period for which an address is being transited; and controlling means for controlling the transistor in accordance with the difference between the comparison voltage generated by the generating means and a reference voltage, thereby to render the transistor conductive and to discharge the second voltage retained in the retaining means through the transistor, when the comparison voltage is lower than the reference voltage, and said controlling means designed to stop operating when the period for which the address signal is being transited is detected by the detecting means.

11. An internal power supply circuit according to claim 10, wherein said control means comprising:

comparing means for comparing the comparison voltage generated by the generating means with the reference voltage; and converting means for converting an output signal of the comparison means into an output signal of a level equivalent to the external voltage, said output signal of the converting means being supplied to a gate of the transistor.

12. An internal power supply circuit according to claim 10, further comprising a depression type transistor having a current path connected between the external voltage and the second end of the current path of the transistor, said depletion type transistor being rendered conductive when the period for which the address signal is being transited is detected by the detecting means.

13. An internal power supply circuit for use in a semiconductor device, comprising:

first boosting means for boosting an external voltage to a second internal voltage of a higher level than that of a first internal voltage used in the semiconductor device, said first internal voltage being higher than the external voltage;

retaining means for retaining the second internal voltage boosted by the first boosting means;

second boosting means for boosting the external voltage to the first internal voltage, said second boosting means having a current supply ability higher than a current supply ability of the first boosting means, and said first internal voltage boosted by the second boosting means being supplied to the semiconductor device; and supply means having an input end connected to a connection node connecting an output end of the first boosting means with the retaining means, and an output end connected to an output end of the second boosting means, said supply means designed to supply, when rendered conductive, the second internal voltage retained in the retaining means to the semiconductor device, when the first internal voltage outputted from the second boosting means is decreased.

14. An internal power supply circuit according to claim 13, wherein said supply means including an N-channel transistor having a current path, an end of which is connected to the connection node connecting the output end of the first boosting means with the retaining means and another end of which is connected to the output end of the second boosting means, and a gate supplied with a voltage higher than the first internal voltage by a difference equivalent to a threshold voltage of the N-channel transistor.

* * * * *